United States Patent [19]

Sandler

[11] 4,290,765

[45] Sep. 22, 1981

[54] POLYOXYALKYLENE POLYCARBOXYLATE ESTERS AND A METHOD OF TREATING POLYESTER FABRIC

[75] Inventor: Stanley R. Sandler, Springfield, Pa.

[73] Assignee: Pennwalt Corporation, Philadelphia, Pa.

[21] Appl. No.: 969,594

[22] Filed: Dec. 14, 1978

[51] Int. Cl.[3] ..... D06B 1/00

[52] U.S. Cl. ..... 8/115.6; 528/296; 560/89; 560/91

[58] Field of Search ..... 8/115.6; 528/296; 560/89, 91

[56] References Cited

U.S. PATENT DOCUMENTS

| | | | |
|---|---|---|---|
| 2,835,696 | 5/1958 | Steinhauer | 560/91 X |
| 3,028,350 | 4/1962 | Hirsch | 528/296 X |
| 3,053,783 | 9/1962 | Broadhead et al. | 528/296 X |
| 3,247,146 | 4/1966 | Royston | 528/296 X |
| 3,288,842 | 11/1966 | Verdol | 560/91 X |
| 3,304,347 | 2/1967 | McGary et al. | 560/91 X |
| 3,498,821 | 3/1970 | Hanson | 8/115.6 X |
| 3,932,356 | 1/1976 | Takagi | 528/296 X |
| 4,087,246 | 5/1978 | Mares et al. | 8/115.6 X |

*Primary Examiner*—Melvyn I. Marquis

[57] ABSTRACT

Polyoxyalkylene polycarboxylate ester is used for imparting soil release properties to textiles such as all polyester fabric either alone or in combination with other textile chemicals.

4 Claims, No Drawings

POLYOXYALKYLENE POLYCARBOXYLATE ESTERS AND A METHOD OF TREATING POLYESTER FABRIC

BACKGROUND OF THE INVENTION

1. Field of the Invention

This invention relates to novel polyoxyalkylene esters prepared by reacting aryl polycarboxylic acid derivatives (e.g., methyl esters, anhydrides, acid chlorides and free acid) with polyoxyalkylene glycols or methoxy polyethylene glycols. This invention also relates to the use of these polyoxyalkylene esters as durable soil release agents for textiles.

2. Description of the Prior Art

Much effort has been expended in designing various compounds capable of conferring soil release properties to fabrics woven from polyester fibers. These fabrics are mostly copolymers of ethylene glycol and terephthalic acid or dimethylterephthalate. These polyester fabrics tend to be hydrophobic, that is, the ability of water to wet the fabric is reduced, and hinder oil, soil and stain removal during the laundering process. Oil stains tend to bind to the polyester surface which is oleophilic; a number of attempts have been made towards building more hydrophilic character into the polyester fabrics so that release of stains is facilitated during laundering.

Since polyester fabrics are susceptible to oily staining, and once stained, are difficult to clean in an aqueous laundry bath, manufacturers of polyester fibers and fabrics have sought to increase the hydrophilic character of the polyester to provide ease of laundering. For example, attempts to solve the soiling problem by using the only available fluorochemical soil release (3M Company's FC-218) have not been particularly satisfactory because of the high cost and insufficient durability to repeated launderings. The use of non-fluorochemical soil release aids, for example, DuPont's Zelcon TGF, and ICI's Milease T are less costly, but these only provide marginal soil release when compared to the untreated polyester fabric after 5 and 10 launderings. Zelcon TGF also suffers from the added disadvantage of poor shelf stability.

Another approach to the problem of increasing the hydrophilic character of polyester fabrics is illustrated in U.S. Pat. No. 3,959,230. This patent teaches the use of a polymeric soil release agent containing ethylene terephthalate and a polyethylene oxide terephthalate; these polymers contain no free carboxyl nor hydroxy groups; the present invention does. These free carboxyl and hydroxy groups on the fabric tend to impart better soil release properties. The polymers of this patent have a high molecular weight in the range of 25,000 to 55,000; the compound of the present invention has a low molecular weight in the range of 500 to 2,000. The high molecular weight polymers make the fabric stiff and unattractive.

None of the above mentioned prior art compounds comes within the scope of the present invention. The compound of the present invention imparts durable soil release properties to 100% polyester fabric at low add-on levels.

STATEMENT OF THE INVENTION

The present invention is directed to a polyoxyalkylene ester having the formula:

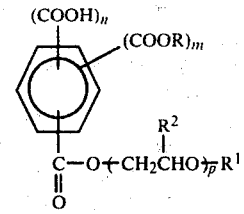

wherein (a) the ring can have all positional isomer arrangements;

(b) R is selected from the group consisting of $$\overset{R^2}{\overset{|}{+CH_2CHO+_p}}R^1 \quad \text{or} \quad +CH_2+_qCH_3$$

(c) $R^1$ and $R^2$ are independently selected from the group consisting of hydrogen and $—CH_3$;

(d) n and m are independently selected from an integer of 0 to 3;

(e) p is an integer of 6 to 23; and (f) q is an integer of 3 to 11.

This invention is also directed to a method of treating the polyester fabric to give the fabric durable soil resistancy and water wicking properties comprising:

(a) wetting a polyester fabric with a composition containing the compound described in the above paragraph to get a sufficient wet pickup;

(b) drying the polyester fabric until the fabric is dry to the touch; and (c) curing the dried fabric in a temperature range of 190° C. to 200° C. for about 45 to 90 seconds.

DETAILED DESCRIPTION OF THE INVENTION

Selected polyoxyalkylene esters of polycarboxylic acids (not condensation polymers) with or without free carboxyl groups of the present invention are particularly effective soil release finishes for polyester. These polyoxyalkylene esters may be prepared by reacting aryl polycarboxylic acid derivatives with polyoxyalkylene glycols or methoxy polyethylene glycols to give the desired ester.

Representative polyoxyalkylene derivatives useful as starting materials in preparing the compounds of this invention are:

(1) Polyoxyethylene glycols, $HO(CH_2CH_2O)_nH$. These glycols are sold under the Trademark Carbowax, with a number as part of the mark, such as: Carbowax 400 or Carbowax 600. The number after the Trademark denotes the average molecular weight.

(2) Methoxyethylene alcohols, $HO(CH_2CH_2O)_nCH_3$. These derivatives are sold under the Trademark Methoxy Carbowax with a number as part of the mark, such as: Methoxy Carbowax 350. The number after the Trademark denotes the average molecular weight.

Preferred polyoxyalkylene glycols or alcohols are those having a molecular weight of about 300 to 1000. The use of polyols with a substantially lower molecular weight results in reduced soil release performance after multiple launderings. The higher molecular weight polyols give compounds with good soil release but poor durability to laundering.

Although the polyoxyethylene derivatives are preferred, compounds containing mixed polyoxyethylene-polyoxypropylene glycols or amino polyethylene glycols-polypropylene glycols are also operable.

Representative aryl polycarboxylic acid derivatives useful as starting materials in preparing the compounds of this invention are based on the di-, tri-, and tetracarboxylic acids of benzene such as phthalic acid, isophthalic acid, terephthalic acid, trimellitic acid, hemimellitic acid, trimesic acid, pyromellitic acid, prehnitic acid, and mellophanic acid.

Preferred polyoxyalkylene polycarboxylate esters are those based on the reaction of polyoxyethylene glycols or derivatives having a molecular weight of 300 to 1000.

Some representative compounds of this invention are:

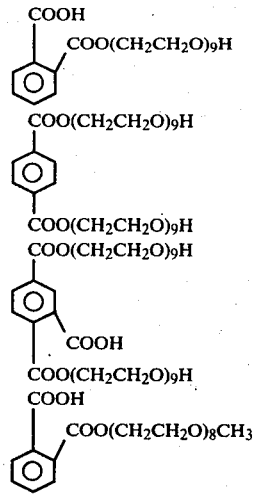

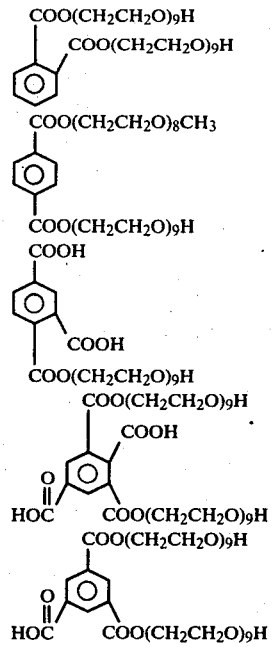

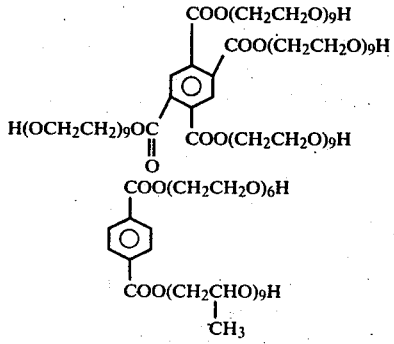

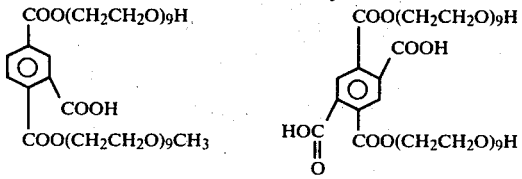

-continued

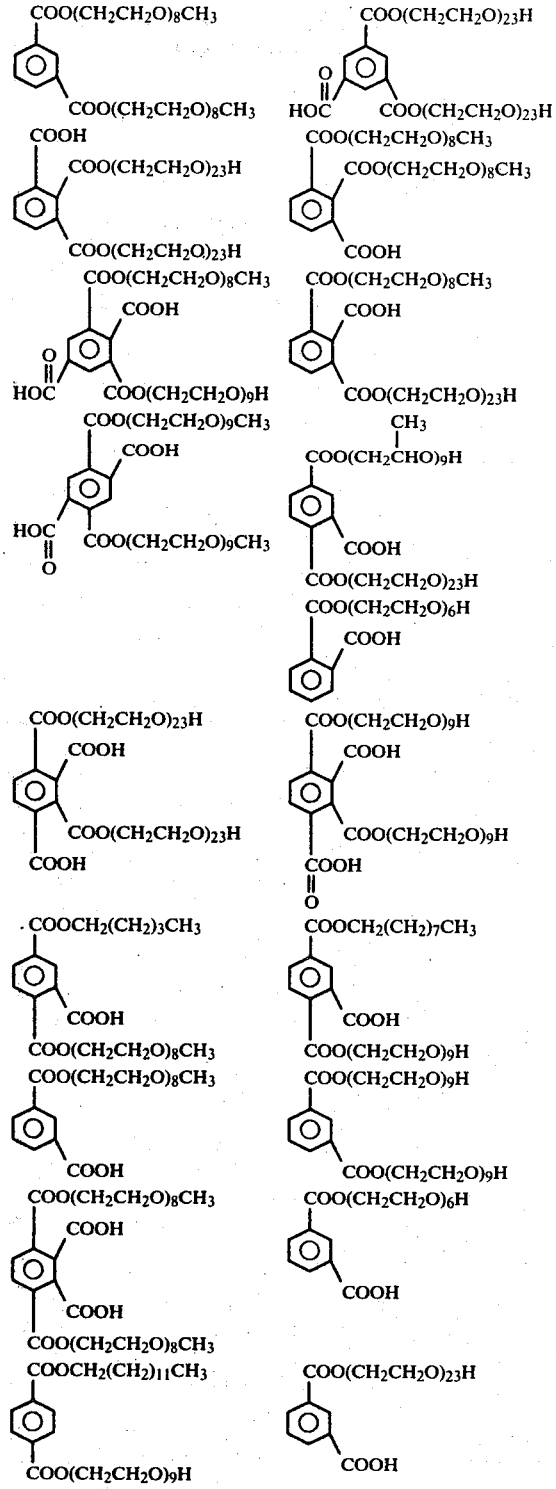

Preferred polyoxyethylene polycarboxylate soil releasing and water wicking compounds are:

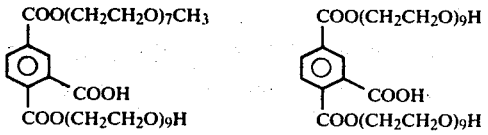

-continued

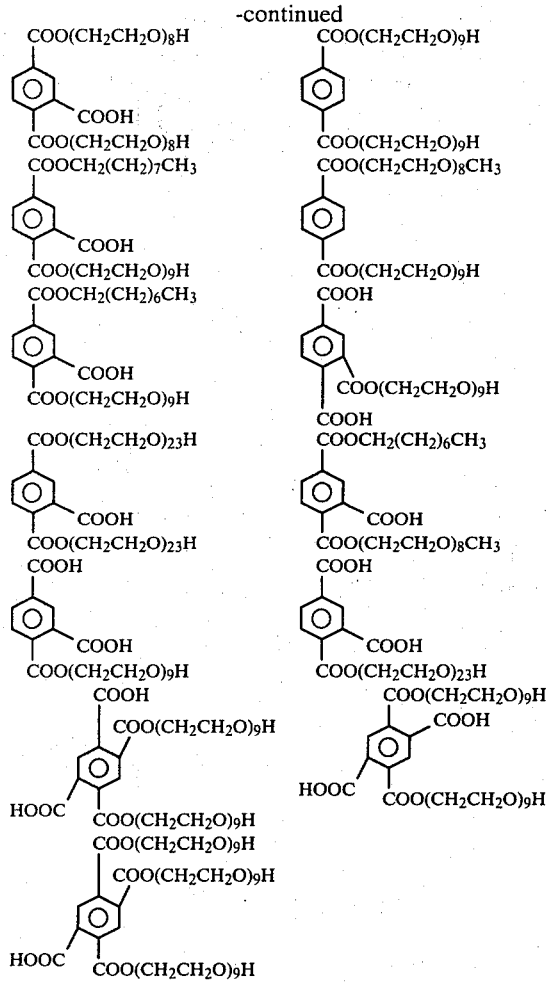

These compounds are applied alone or in combination with other textile chemicals and may be heat set in the surface of the polyester fabric to give soil release properties durable to at least 10 launderings. These compounds are shelf stable and give improved color fastness to crocking when applied by dye fabric. In the treatment of fabrics such as 100% polyester, the novel compounds can be applied in any convenient manner, but typically either from solvent or aqueous pad baths, to give, typically, a wet pickup of about 70 to 100%. The fabrics are then dried for 3.5 to 10 minutes as indicated at about 110° C. and cured preferably for about 90 seconds at about 190° to 200° C.

The use of the compounds of the present invention with inherently flame retarded polyester or polyester containing flame retardant finishes (in the same bath or as a topical treatment such as tris (2,3-dibromopropyl)-phosphate gives improved soil release properties to the treated fabric without a reduction in the flame retardancy.

In the following examples, which illustrate the subject invention but are not in limitation thereof, stain removal is evaluated by visual observation using Test Method 130-1974 as described in the Technical Manual of the American Association of Textile Chemists and Colorists (AATCC), (Howes Publishing Co., 44 E. 23rd St., New York), with overhead lighting arranged as described in the test procedure. The fabrics are stained with Nujol according to the test method and additionally with butter, Wesson Oil, and mustard as in the Sears Test, TP-1-4; then they are washed according to Test Method 130-1974, placed on a black table top in front of a viewing board having "standard" specimens, and rated according to the criteria shown in the following table:

TABLE 1

| Rating | Appearance |
|---|---|
| 5 | negligible or no staining (excellent cleanability) |
| 4 | slightly stained (good cleanability) |
| 3 | noticeably stained (fair cleanability) |
| 2 | considerably stained (poor cleanability) |
| 1 | heavily stained (very poor cleanability) |

The fabrics are evaluated for water wicking using the following test procedure. In this test, 12×12-inch specimens are cut in the warp or fill directions of the fabric and conditioned for 4 hours at 65% relative humidity (R.H.) at 70°±2° F. The samples are then immersed in one inch of water of 300 ml water contained in a 600 ml beaker. Without removing the specimens, the distance the water wicked up the fabric, in inches, after one and five minutes is recorded.

EXAMPLE 1

To 158 g (0.75 mole) of trimellitic anhydride monoacid chloride is added 97.5 g (0.75 mole) of n-octanol. The mixture is heated at 110°-130° C. for about one to two hours or until evolution of hydrogen chloride ceases. Then 300 g (0.75 mole) of Carbowax 400 is added all at once and the resulting mixture heated at 110°-130° C. until the anhydride absorption in the infrared spectrum disappears. The product is isolated in essentially quantitative yield and is a dark, viscous liquid. The molecular weight calculated is 704 and the molecular weight found by analysis is 713. The infrared spectral data is consistent with the assigned structure:

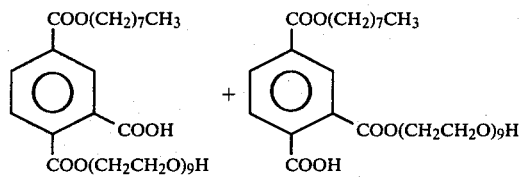

Isomers

EXAMPLE 2

To 1200 g (3.0 mole) of Carbowax 400 heated at 110°-135° C. is added portionwise 315 g (1.5 mole) of trimellitic anhydride monoacid chloride with vigorous stirring. After all hydrogen evaluation ceases and the anhydride absorption (5.65 microns) in the infrared spectrum is gone, the product is isolated in essentially quantitative yield. The evaluated molecular weight is 973 and the molecular weight found is 878. The infrared spectral data is consistent with the assigned structure as:

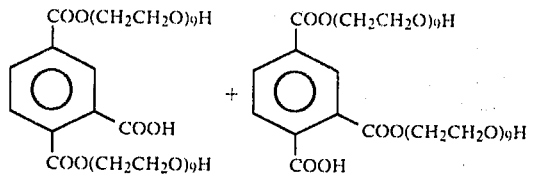

Isomers

EXAMPLE 3

To 105 g (0.5 mole) of trimellitic anhydride monoacid chloride is added 175 g (0.5 mole) of Methoxy Carbowax 350. The mixture is heated for 1-2 hours at 110°-130° C. until the hydrogen chloride evolution ceases. Then 200 g (0.5 mole) of Carbowax 400 is added all at once and the mixture heated at 110°-130° C. until the anhydride absorption band in the infrared spectrum (5.65 microns) disappears. The product is obtained as a honey-colored viscous liquid in essentially quantitative yield. Molecular weight calculated, 925; molecular weight found, 902. The ir spectral data is consistent with the assigned structure:

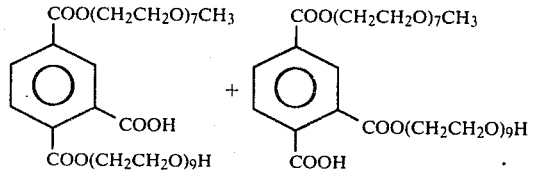

Isomers

EXAMPLE 4

To 61.2 g (0.3 mole) of terephthaloyl chloride is added 240 g (0.6 mole) of Carbowax 400. The mixture is heated for approximately 4 hours until all the hydrogen chloride of the reaction is evolved. The product is a clear, viscous liquid which is obtained in essentially quantitative yield with an analysis consistent with the assigned structure:

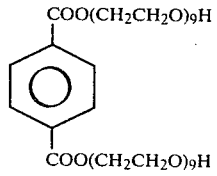

EXAMPLE 5

To 96 g (0.5 mole) trimellitic anhydride is added 200 g (0.5 mole) of Carbowax 400 and 250 ml tetrahydrofuran. The mixture is refluxed until the anhydride band (5.65 microns) in the infrared spectrum disappears. The solvent is removed under pressure to afford the product in essentially quantitative yield. Neutralization equivalent calculated, 296; neutralization equivalent found, 311. Their spectral data is consistent with the assigned structure:

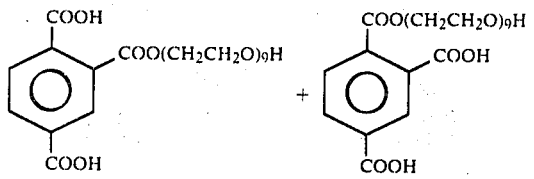

Isomers

EXAMPLE 6

To 65.4 g (0.3 mole) of pyromellitic dianhydride is added 240 g (0.6 mole) of Carbowax 400. The mixture is heated for 4 hours at 150°-170° C. to give a clear solution. The product is isolated in essentially quantitative yield and the analysis is consistent with the assigned structure:

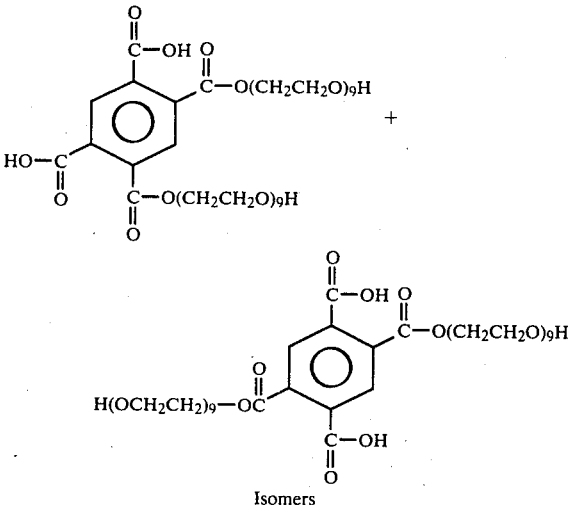

Isomers

EXAMPLE 7

To 10.1 g (0.05 mole) of terephthaloyl chloride is added 400 g (0.1 mole) of Carbowax 4000. The mixture is heated for approximately 4 hours until all the hydrogen chloride of reaction is evolved. The product is a clear, viscous liquid which is obtained in essentially quantitative yield with an analysis consistent with the assigned structure:

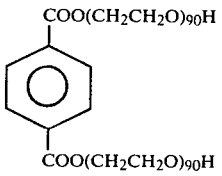

EXAMPLE 8

To 111.0 g (0.75 mole) of phthalic anhydride is added 300 g (0.75 mole) of Carbowax 400. The mixture is heated at 100° C. for one hour and then to 125°-135° C. until the anhydride absorption band in the infrared spectrum (5.65 microns) disappears (approx. 6 hours). The product is obtained as a clear viscous oil in essentially quantitative yield. The infrared spectral analysis is consistent with the assigned structure:

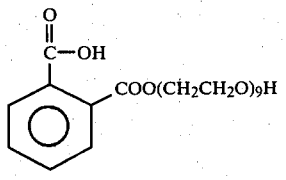

Results

Soil Release and Water Wicking Results of Compounds of Examples 1 to 6 Using 100% Undyed Polyester. 3.1 ox/yd$^2$

| Example No. | % Solids Add-on | Soil Release[a] 5-Wash | 10-Wash | 25-Wash | Water Wicking[b] 5 Washes 1 min. | 5 min. |
|---|---|---|---|---|---|---|
| Fabric Blank | — | 2.4 | 2.6 | 2.5 | 0.9 | 1.9 |
| 1 | 2.1 | 3.9 | 3.6 | 2.6 | 1.3 | 2.4 |
| 2 | 2.1 | 3.5 | 3.0 | 2.8 | 1.1 | 2.0 |
| 3 | 2.1 | 3.3 | 3.1 | 2.8 | 1.3 | 2.3 |
| 4 | 1.4 | 3.1 | 3.1 | 2.6 | 1.1 | 2.1 |
| 5 | 0.7 | 3.0 | 2.6 | — | 1.1 | 2.1 |
| 6 | 1.7 | 2.6 | 2.6 | 2.5 | 1.5 | 2.5 |
| 7 | 3.5 | 2.1 | 2.1 | — | 1.3 | 2.4 |
| Zelcon TGF | 2.1 | 2.3 | 2.4 | 2.1 | 1.4 | 2.8 |
| Milease T | 1.4 | 2.8 | 2.5 | 2.3 | 1.3 | 2.3 |

[a]The value of 5 is the best rating and 1 is the worst.
[b]The higher the number, the better the wicking action.

Evaluation of Compounds of Examples 1 to 6 and 8 as Soil Release Aids to Tris(2,3-dibromopropyl)phosphate ("Tris") Finish for 100% Undyed Polyester. 5.8 oz/yd$^2$

| Example No. | % Solids Add-on | Calcd. % Br | Soil Release[a] AATCC Test Method 130-1974 and Sears Test #TP-1-4 5-Wash | 10-Wash | Flame Retardance[b] DOCFF-3-71 Char length-inches 25-Wash | 50-Wash |
|---|---|---|---|---|---|---|
| Tris Alone | 12.0 | 8.3 | 1.8 | 2.3 | 1.7 | 1.7 |
| Tris with Composition of Example No. Shown | | | | | | |
| 1 | 14.4 | 7.2 | 2.0 | 2.5 | 1.9 | 2.9 |
| 2 | 14.2 | 7.1 | 2.3 | 2.5 | 1.6 | 1.9 |
| 3 | 16.5 | 8.2 | 2.4 | 2.8 | 1.8 | 2.0 |
| 4 | 14.8 | 7.4 | 2.3 | 3.0 | 2.1 | 2.2 |
| 5 | 17.3 | 8.6 | 2.8 | 3.4 | 3.0 | 1.6 |
| 6 | 15.4 | 7.6 | 2.4 | 2.9 | 1.5 | 1.7 |
| 8 | 13.6 | 6.8 | 1.9 | 2.8 | 1.7 | 1.8 |

[a]The higher the number, the better soil release.
[b]7 inches or less is passing in this test.

Color Fastness to Crocking Using 100% Polyester Dark Brown, 6.9 oz/yd$^2$ Fabric

| Sample No. | % Add-on | Color Fastness - Crocking Meter Method - AATCC Test Method 8-1974 Initial[a] Dry | Wet |
|---|---|---|---|
| Zelcon TGF | 2.3 | 3.0 | 2.5 |
| Milease T | 2.7 | 2.0 | 2.0 |
| Example 2 | 2.4 | 4.0 | 3.5 |
| Example 4 | 2.1 | 4.0 | 4.0 |

[a]Color pick-up of the test swatch was rated using the AATCC Chromatic Transfer Scale. The higher the number, the less dye transfer to the test swatch.

What is claimed:

1. A method of treating polyester fabric to give the fabric a durable, soil resistancy and water wicking properties comprising (a) wetting a polyester fabric with a composition containing a compound having the formula:

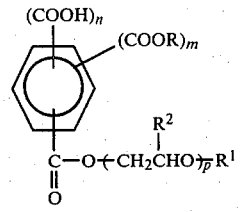

wherein (1) the ring can have all positional isomer arrangements;

(2) R is selected from the group consisting of $$\left(CH_2\overset{R^2}{\overset{|}{C}}HO\right)_p R^1 \text{ or } \left(CH_2\right)_q CH_3;$$

(3) $R^1$ and $R^2$ are independently selected from the group consisting of hydrogen and $—CH_3$;

(4) n and m are independently selected from an integer of 0 to 3;

(5) p is an integer of 6 to 23; and (6) q is an integer of 3 to 11;

(b) drying the polyester fabric until the fabric is dry to the touch; and (c) curing the dried fabric in a temperature range of 190° to 200° C. for about 45 to 90 seconds.

2. The method of claim 1 wherein the composition further contains tris(2,3-dibromopropyl)phosphate to give improved soil release and flame retardancy.

3. The treated fabric of claim 1.

4. The treated fabric of claim 2.

* * * * *